US008590460B2

(12) United States Patent
Wike

(10) Patent No.: US 8,590,460 B2
(45) Date of Patent: Nov. 26, 2013

(54) RAILWAY FREIGHT CAR TRUCK

(75) Inventor: Paul Steven Wike, St. Louis, MO (US)

(73) Assignee: Amsted Rail Company, Inc., Chicago, IL (US)

( * ) Notice: Subject to any disclaimer, the term of this patent is extended or adjusted under 35 U.S.C. 154(b) by 241 days.

(21) Appl. No.: 13/134,647

(22) Filed: Jun. 14, 2011

(65) Prior Publication Data

US 2012/0318166 A1 Dec. 20, 2012

(51) Int. Cl.
*B61F 5/12* (2006.01)

(52) U.S. Cl.
USPC ..... 105/198.3; 105/198.4

(58) Field of Classification Search
USPC ..... 105/198.2–198.5, 197.05, 200, 201, 105/208, 208.1, 218.1
See application file for complete search history.

(56) References Cited

U.S. PATENT DOCUMENTS

| | | | | | |
|---|---|---|---|---|---|
| 2,625,117 | A | * | 1/1953 | Van Der Sluys | 105/208 |
| 2,630,079 | A | * | 3/1953 | Cottrell | 105/197.2 |
| 2,705,633 | A | * | 4/1955 | Potter, Jr. et al. | 267/211 |
| 2,782,731 | A | * | 2/1957 | Blattner | 105/191 |
| 3,837,292 | A | * | 9/1974 | Wiebe | 105/198.3 |
| 4,132,176 | A | * | 1/1979 | Wiebe | 105/198.3 |
| 6,142,081 | A | * | 11/2000 | Long et al. | 105/218.1 |

* cited by examiner

*Primary Examiner* — Zachary Kuhfuss
(74) *Attorney, Agent, or Firm* — Edward J. Brosius

(57) ABSTRACT

An improved railway car truck is provided that includes two sideframes and a bolster. The bolster has laterally opposite ends, each end extending into and supported within a sideframe opening on a spring group. Each sideframe also has a pedestal opening at each end to receive a bearing adapter assembly. The railway car truck also includes a transom extending into and supported within a sideframe opening. The spring group is supported at each transom end. A lateral damping cylinder is connected between the bolster and the transom. A vertical damping cylinder is connected between the bolster and the sideframe.

12 Claims, 8 Drawing Sheets

RAILWAY FREIGHT CAR TRUCK

BACKGROUND OF THE INVENTION

The present invention relates to a railway freight car truck and, more particularly, to an improved railway freight car truck having lateral and vertical damping with a pedestal jaw arrangement allowing passive steering.

In a railway freight car truck, two axle wheel sets are held in a pair of laterally spaced sideframes, with a bolster extending laterally between and supported on each sideframe by spring groups. A transom is provided having ends that extend into an opening in each sideframe. The ends of the transom provide support for the spring groups. The transom ends are supported on the lower portion of the center openings of the sideframes, on transom bearings.

Two wheels are press fit on each of two axles, with the ends of the axles also fitted with a roller bearing assembly. The roller bearing assembly itself supports a bearing adapter that is fit into a pedestal jaw opening at the longitudinal end of each sideframe. A bearing adapter pad assembly is positioned between the bearing adapter and the roller bearing assembly. The bearing adapter, which is itself fit on top of the bearing assembly, is comprised of a unitary cast steel piece. The adapter pad is usually formed of a unitary elastomeric structure and is fitted on top of the bearing adapter.

The pedestal jaw and transom bearing rotate in unison about the sideframe creating lateral displacement of the transom. The lateral damper extends from the transom to the bolster. The lateral damper limits the lateral acceleration and displacement in the bolster.

Two side bearings are also typically provided on an upper surface of the bolster to assist in supporting a car bolster that is part of the structure of the freight car.

It is an object of the present invention to provide an improved railway truck having improved performance. Such improved performance is provided by vertical damping between the bolster and the sideframe and by lateral damping between the bolster and the transom. The performance is also enhanced by the rotating pedestal jaw connection to the adapter pad.

SUMMARY OF THE INVENTION

A railway freight car truck of the so-called three piece standard design, is comprised of two laterally spaced, unitary cast steel sideframes and a laterally extending bolster, also of a unitary cast steel structure. Pedestal jaws allowing rotation of the bearing adapter assembly provide passive steering. A transom is provided having ends that extend into an opening in each sideframe. The ends of the transom are received and supported on transom bearings that themselves are supported by the sideframes. The spring groups are supported on the top of the transom and support the bolster.

For improved performance of the railway freight car truck, it is desirable to utilize lateral damping, usually in the form of a hydraulic cylinder connected and extending between bottom of the bolster and extending to the transom. It is also desirable to provide vertical damping in the form of a hydraulic cylinder, or preferably two hydraulic cylinders, that connect and extend between a vertical column of a sideframe and the bolster.

DETAILED DESCRIPTION OF THE INVENTION

Figure 1:
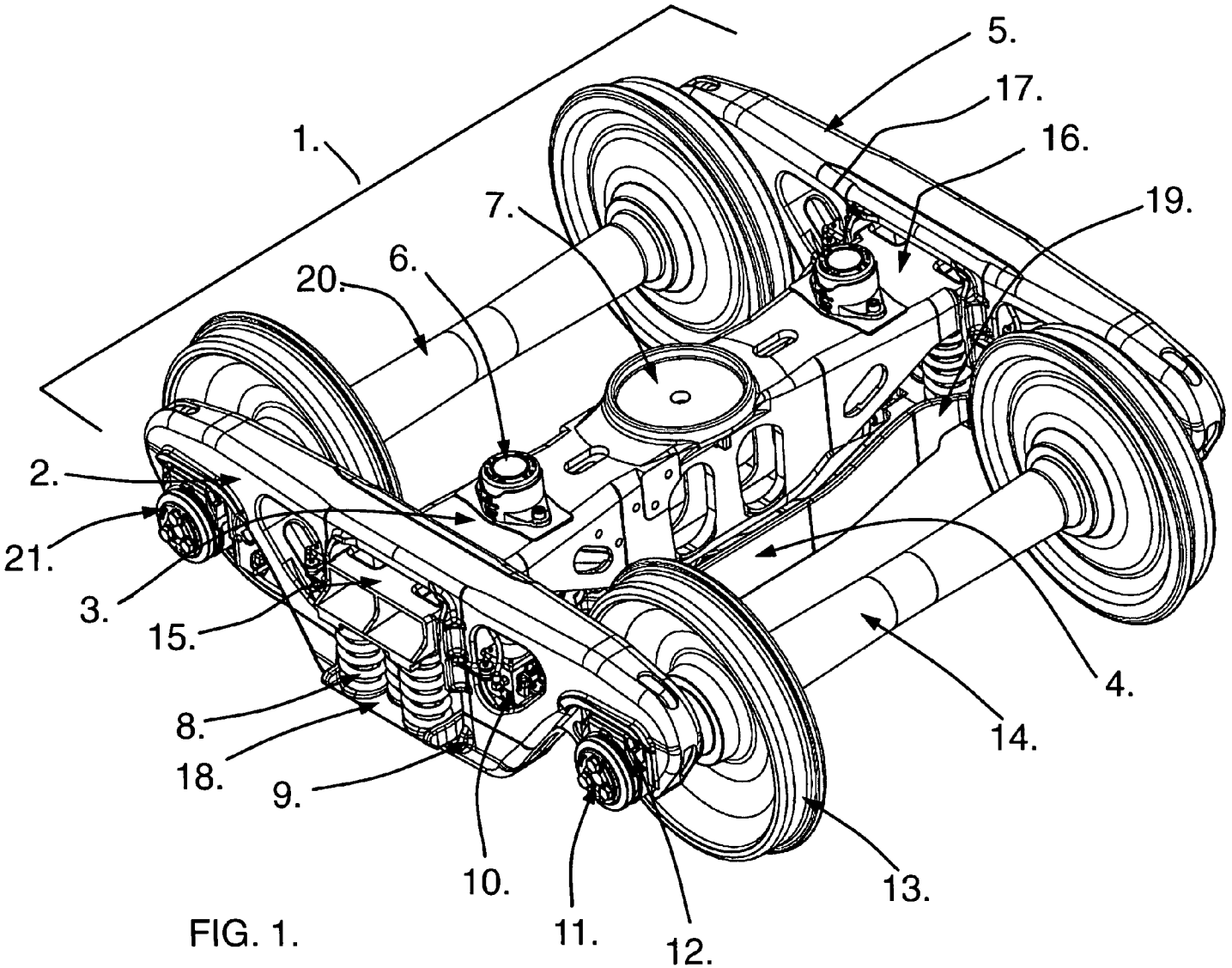
FIG. 1 is a side perspective of a first embodiment of a railway car truck in accordance with the present invention.

Referring now to FIG. 1, a railway truck assembly 1, is seen to comprise of two laterally spaced sideframes 2 and 5, between bolster 3. Bolster 3 is seen to include bolster ends 15 and 16, which extend through sideframe openings 17. Transom 4 extends laterally under bolster 3, and includes transom ends 18 and 19. Spring group 8 is seen to support bolster end 15 on transom end 18, which is supported on rod bearing 9. Rod bearing 9, is supported at the bottom corners of the sideframe opening 17.

Each of the sideframes 2 and 5, and bolster 3, are usually a cast steel unitary structure. Various internal ribs and supports lend strength, along with a savings in overall weight for each of such cast steel truck components. Transom 4 can be cast of ductile iron or steel. It is possible for transom 4 to be fabricated of steel, but a cast ductile iron transom is preferred. The rod bearing 9 preferably is cast of ductile iron or steel.

Bolster 3 is also seen to include on its upper surface a bolster center plate 7. Also included on the upper surface of bolster 3 is a pair of laterally spaced sidebearings 6.

Axles 14 and 20, extend laterally between sideframes 2 and 5. Railway wheels 13, are press fit on the ends of axles 14, and 20. The ends of axles 14 and 20, are received in roller bearings 11 and 21, respectively; roller bearing 11 itself supports bearing adapter 12.

Figure 2:
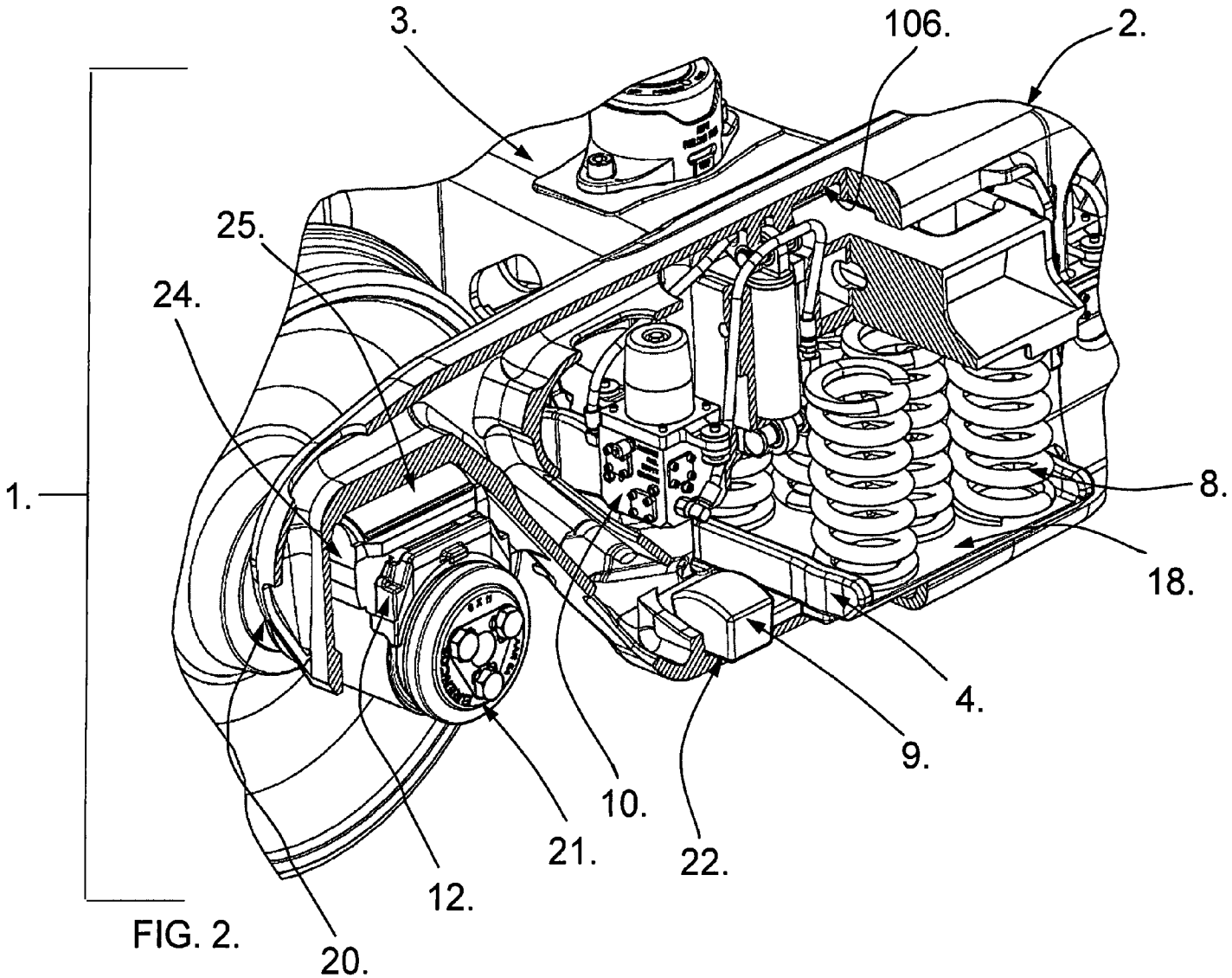
FIG. 2 is a partial detailed cut away view of the first embodiment of a railway car truck in accordance with the present invention.

Referring now to FIG. 2, a partial cross sectional view of railway truck assembly 1 is shown along with detailed partial views of bolster 3. Transom 4 extends laterally between sideframes 2 and 5 (not shown). Transom end 18 is supported on rod bearing 9. Rod bearing 9 is supported on the sideframe lower support 22. Axle 20 end is received in roller bearing 21. Roller bearing 21, supports bearing adapter 12, and adapter pad 23 (not shown), as well as rotating pedestal jaw 24 and plan bearing 25.

Figure 3:
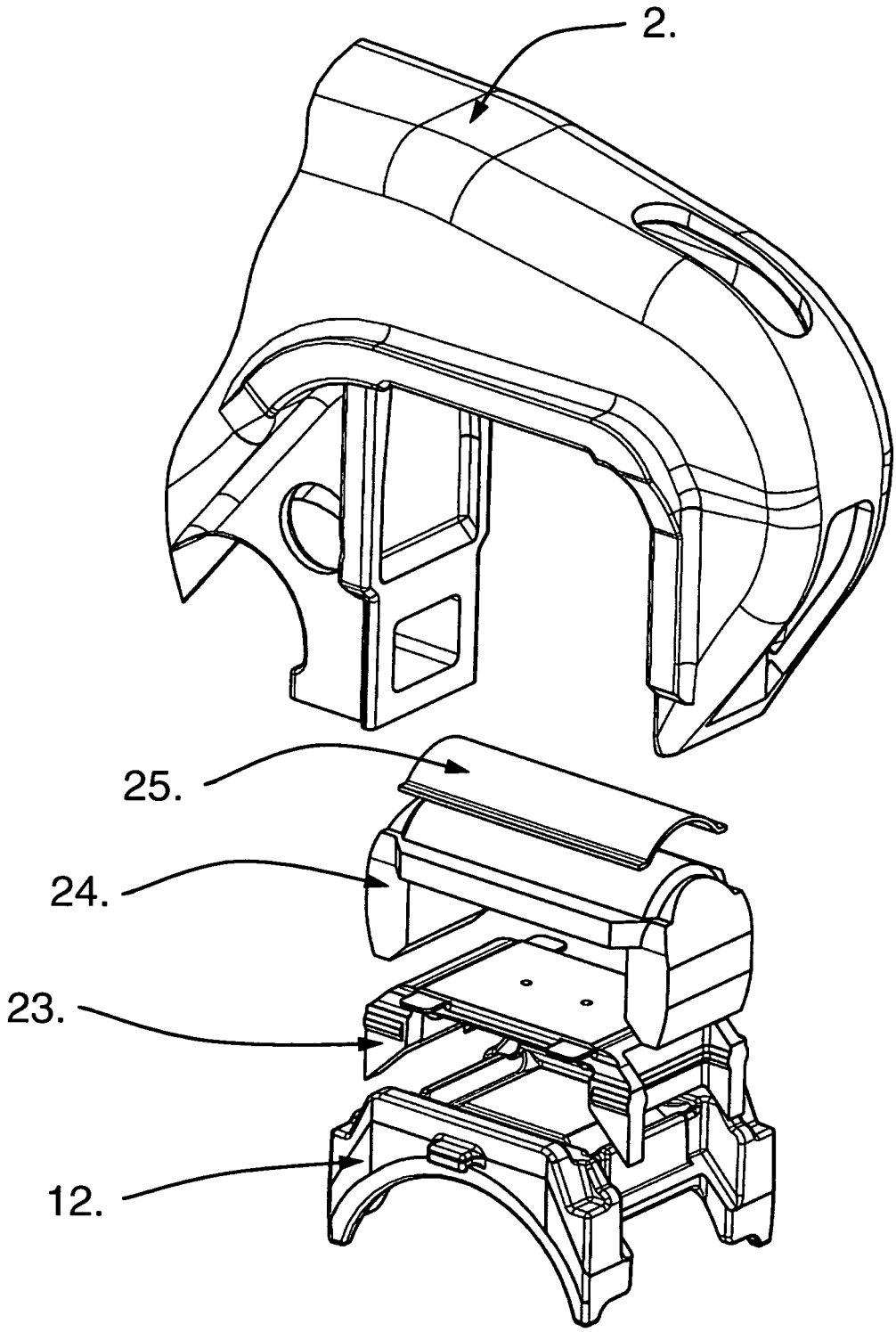
FIG. 3 is a exploded perspective view of the pedestal end of the sideframe, with a expanded view of the rotating pedestal jaw, adapter pad and bearing adapter a first embodiment of a railway car truck in accordance with the present invention.

Referring to FIG. 3, bearing adapter 12, supports adapter pad 23. Adapter pad 23, is typically comprised of an elastomeric material. Adapter pad 23, is supported vertically by rotating pedestal jaw 24. The rotating pedestal jaw 24, has a cylindrical surface that is supported on a cylindrical plan bearing 25. The cylindrical plan bearing 25 is supported by a complementary cylindrical surface (not shown) of the sideframe 2 pedestal jaw roof.

Figure 4A:
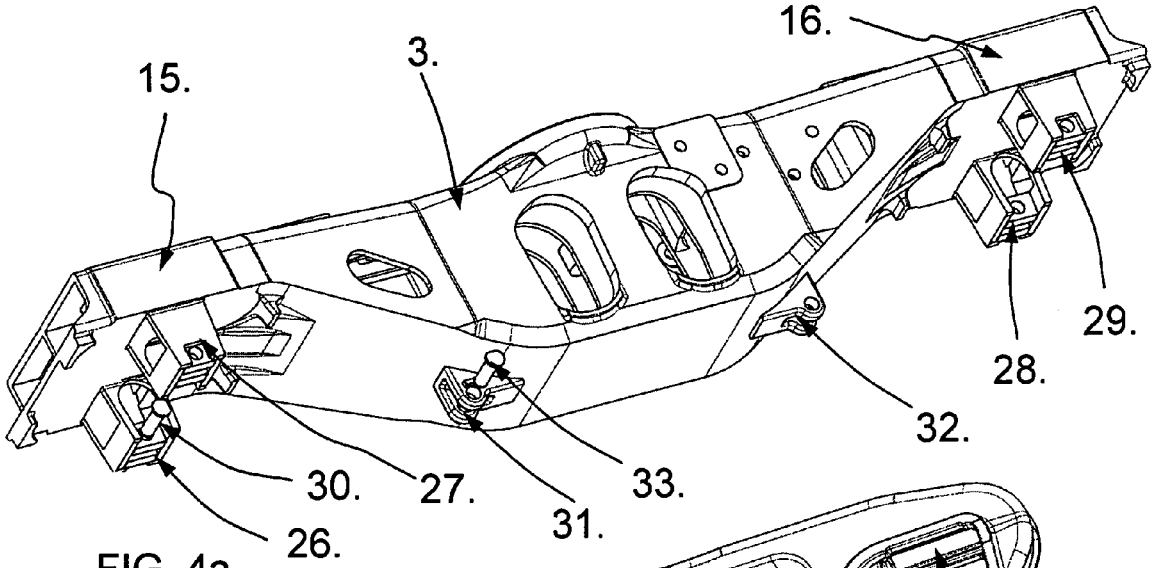
FIG. 4*a* is a view of a bolster of a first embodiment of a railway car truck in accordance with the present invention.

Referring now to FIG. 4*a*, bolster 3, is typically a cast steel unitary device, with internal ribs and supports to provide the strength necessary for a structural component of a railway freight car truck assembly 1, while providing a generally lower weight structure. Bolster 3, includes four pockets 26, 27, 28, 29 that extend downwardly, two at each of the bolster ends 15 and 16. The bolster pockets receive the vertical damper cylinders 56 (not shown) and are pinned in place with pin 30. Bolster 3, has two lugs 31, and 32, located inward on the bolster 3, bottom surface to receive the lateral damper 56 (see FIG. 5*d*) and attached with a pin 33.

Figure 4B:
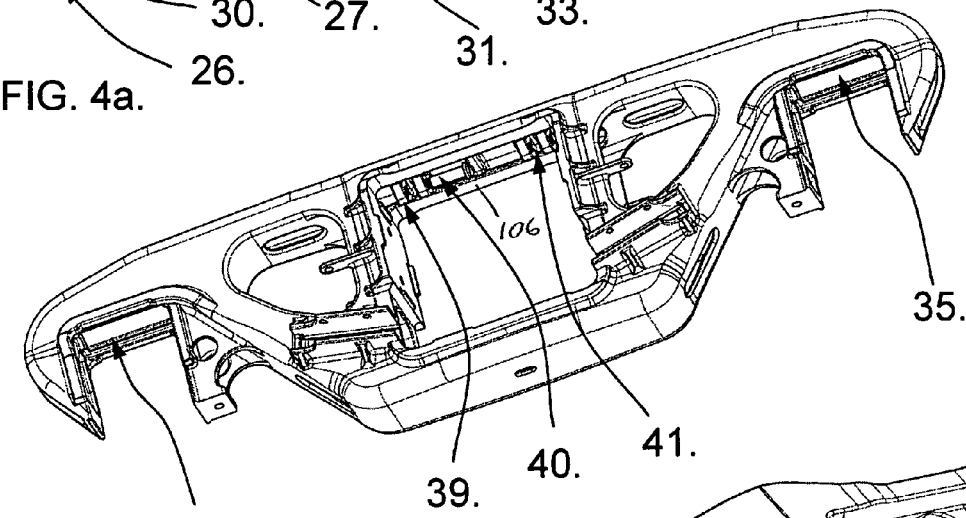
FIG. 4*b* is a perspective bottom view, of the sideframe of the first embodiment of a railway car truck in accordance with the present invention.

Referring now to FIG. 4*b*, sideframe 2 is also seen to have laterally spaced pedestal openings 34 and 35. Each pedestal opening 34 and 35, is adapted to receive a plan bearing 25, (not shown) and rotating pedestal jaw 24 (not shown). The vertical damper cylinder 56 (not shown) is attached at lugs 39 and 41 with pin 40.

Figure 4C:
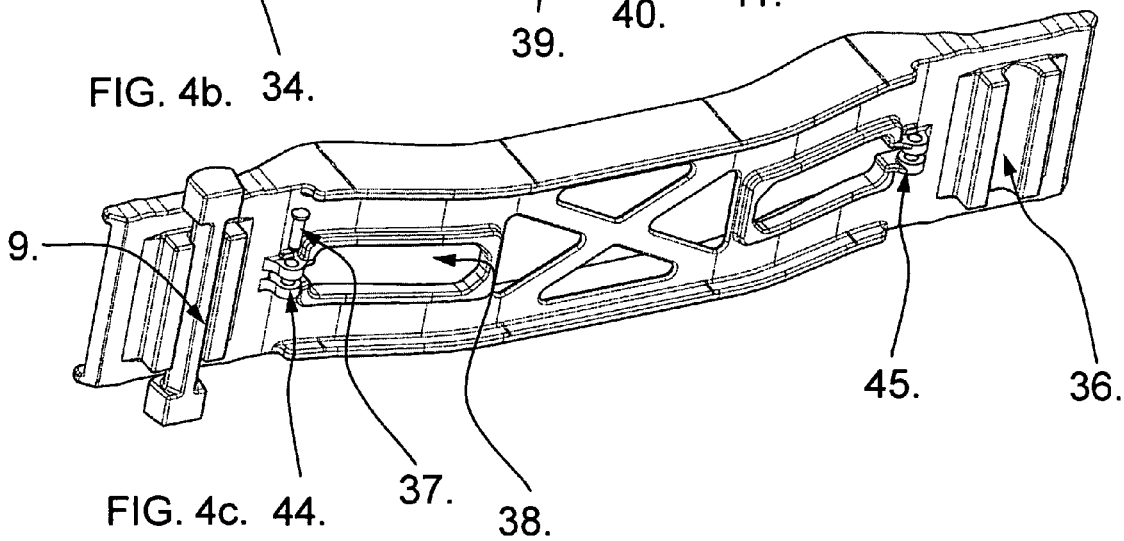
FIG. 4*c* is a perspective bottom view, of the transom and transom rod bearing of the first embodiment of a railway car truck in accordance with the present invention.

Referring now to FIG. 4*c*, a bottom perspective of transom 4 and rod bearing 9 in shown. Transom 4 is supported in the cylindrical recess 36 by rod bearing 9. The lateral damper cylinder 43 (not shown) extends through transom 4, at aperture 38. The lateral damper cylinder 43, (not shown) is affixed to transom 4 by pin 37.

Referring now to FIGS. 5*a*, 5*b*, and 5*c*1 the section of the rotating pedestal jaws 24, and rod bearing 9, rotating in unison through the sideframes 2 and 5 is shown. The rotation of the rotating pedestal jaws 24, and rod bearing 9, provide lateral translation of the transom 4.

Figures 5A, 5B, 5C, 5D, 5E, 5F:
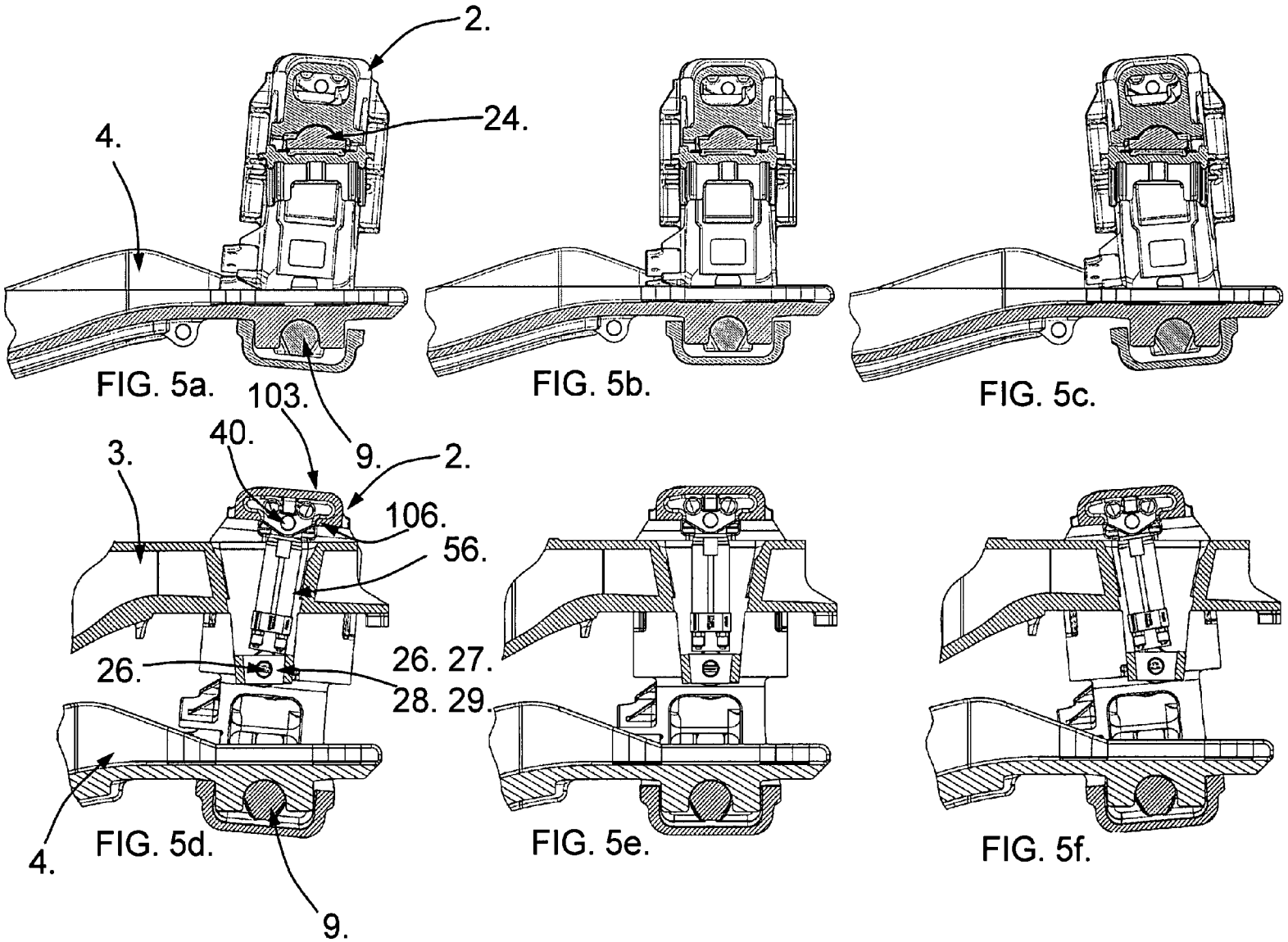
FIG. 5*a*, 5*b*, 5*c* is a cross-section view showing the rotation relationship of the rotating pedestal jaw through the sideframe to the transom a first embodiment of a railway car truck in accordance with the present invention.
FIG. 5*d*, 5*e*, 5*f* is a detailed a cross-section view of showing the rotation relationship of the vertical damper attached at the sideframe and bolster a first embodiment of a railway car truck in accordance with the present invention.

Referring now to FIGS. 5*d*, 5*e*, and 5*f*, shows the cross section of the vertical damper cylinder 56, connected to bolster 3, and to sideframes 2 and 5. The vertical damper cylinder 56 is pinned in bolster pockets 26, 27 and 28, 29 by use of bolster pin 26. The vertical damper cylinder 56 is also pinned in an under surface 106 of the top section 103 the sideframes 2, and 3 by use of sideframe pin 40. During the rotation about sideframes 2, and 3, vertical damper 56, is free to rotate in limited extent in bolster pockets 26, 27 and 28, 29.

The vertical damping cylinders provide a damping pace of about 600 pounds per inch, per second. (10,715 kg. per meter per second) of travel.

Figure 6A:
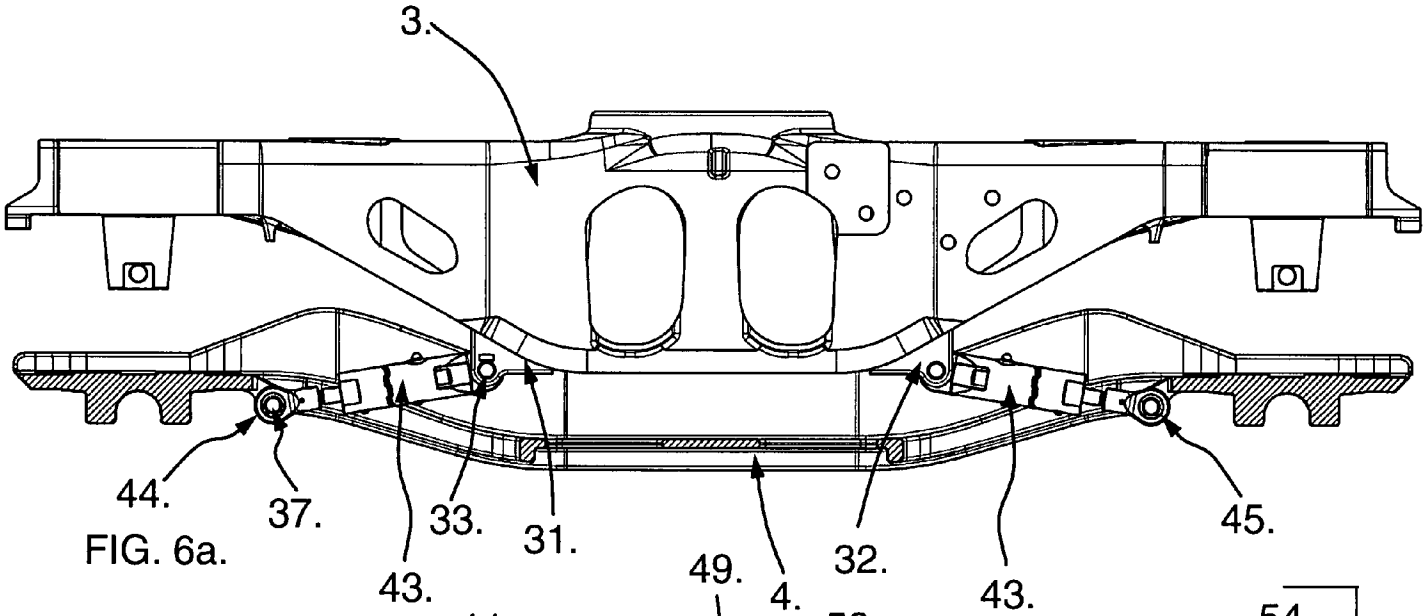
FIG. 6*a* is a front section view of the relationship of the bolster to the transom with the lateral damper extending from the bolster to transom a first embodiment of a railway car truck in accordance with the present invention.

Referring now to FIG. 6*a*, a front view of bolster 3 is shown, with a section view of transom 4. The lateral damper cylinders 43 extend from lugs 31, and 32, on bolster 3, to lugs 44, and 45, on transom 4. Lateral damper cylinder 43, is affixed to bolster 3, by pin 33. Lateral damper cylinder 43 is affixed to transom 4, by pin 37.

Figure 6B:
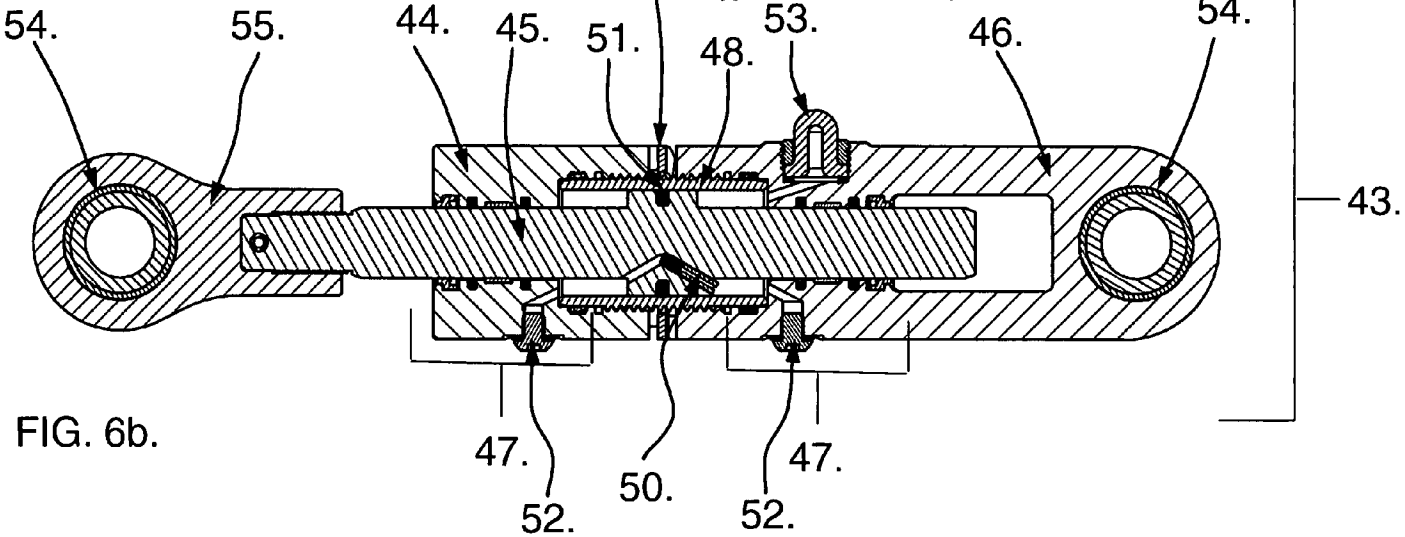
FIG. 6*b* is a cross section view of the lateral damper of a first embodiment of a railway car truck in accordance with the present invention.

Referring now to FIG. 6*b*, a cross section view of lateral damper cylinder 43 is shown. Lateral damper cylinder 43, consists of a front packing 44, a piston rod 45, and a rear packing 46. The front packing 44, and rear packing 46, contain seals 47, to retain the hydraulic fluid within lateral damper 43. The front packing 44 and rear packing 46, are threaded on to barrel 48. The front packing 44 and rear packing 46, are retained by locking ring 49. The piston rod 45, has a orifice 50, which restricts the flow of hydraulic fluid from one side of the piston rod 45, to the other. Hydraulic fluid flow is prevented between the barrel 48, and piston rod 45, by seal 51. Hydraulic fluid fill ports 52, are provided on the front packing 44, and rear packing 46. A hydraulic fluid sight glass 53, on the rear packing 46, provides a fluid level indicator. Spherical bearings 54 are press fit on rear packing 46, and rod eye 55.

The lateral damping cylinders provide a damping force of about 199 pounds per inch, per second (3,559 kg. per meter per second) of travel.

Figures 7A, 7B, 7C:
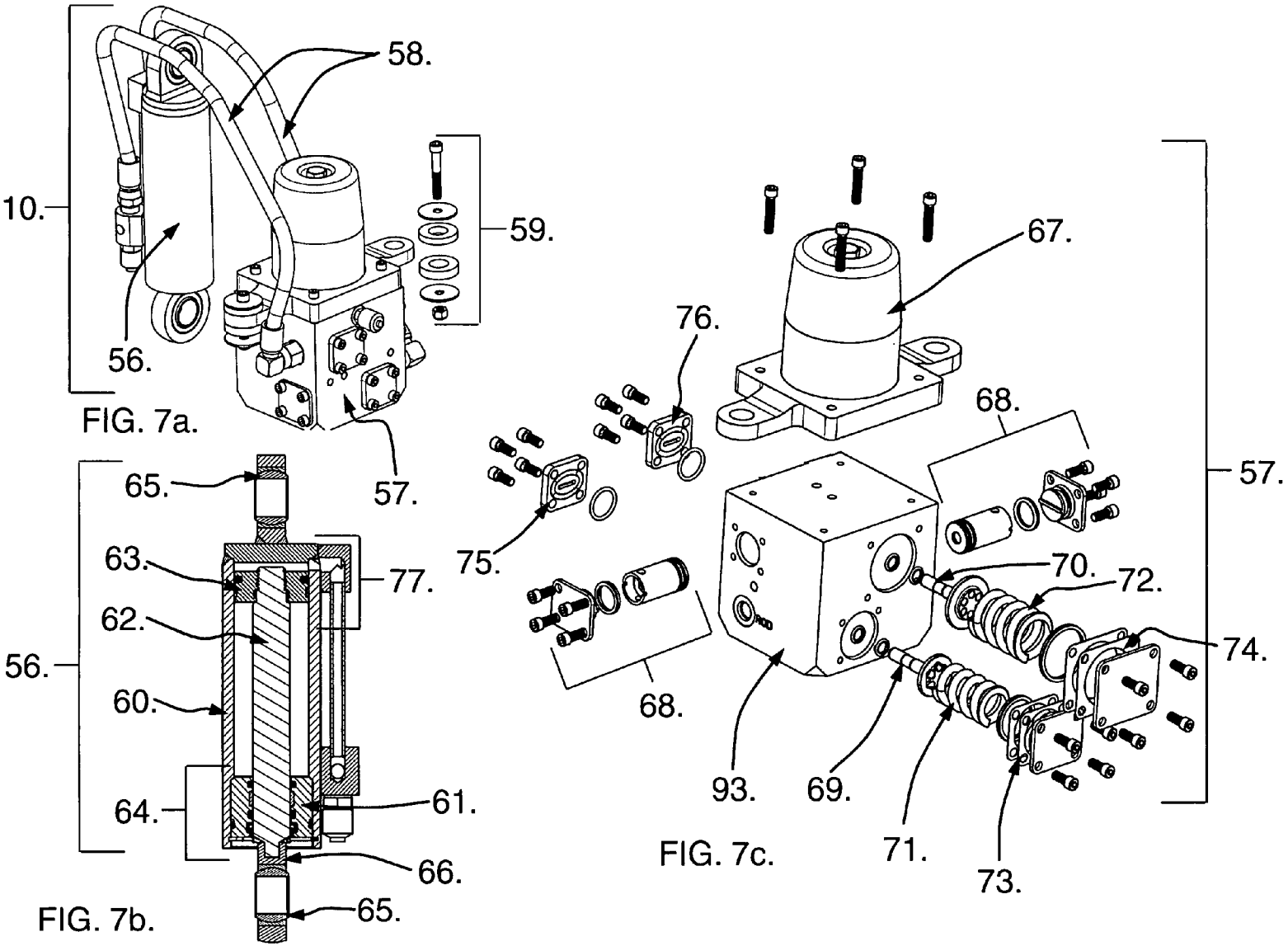
FIG. 7*a* is a perspective view of the vertical damper and control valve of a first embodiment of a railway car truck in accordance with the present invention.
FIG. 7*b* is a detailed cross-section view of the vertical damper of a first embodiment of a railway car truck in accordance with the present invention.
FIG. 7*c* is a detailed exploded view of the control valve a first embodiment of a railway car truck in accordance with the present invention.

Referring now to FIG. 7*a*, a perspective view of the vertical damper 10 is shown, which consists of vertical damping cylinder 56, control valve 57, connected by two hoses 58. Control valve 57, is mounted to sideframes 2, and 3, (not shown) with shock mounts 59.

Referring now to FIG. 7*b*, a cross section of vertical damping cylinder 56 is shown. Vertical damping cylinder 56, consists of a barrel 60, packing 61, rod 62, and piston 63. The hydraulic fluid is retained between the barrel 60, and rod 62, by seals 64. The barrel 60 is affixed with a spherical bearing 65. Rod 62 is welded to rod eye 66, which is also affixed with a spherical bearing 65.

Referring now to FIG. 7*c*, an exploded view of control valve 57 is shown. Control valve 57 consists of accumulator 67, check valves 68, spools 69 and 70, as well as springs 71, and 72. There are two shims 73 and 74, provided to adjust variation in the spring stiffness. There are also two slotted pilot plates 75 and 76. In pilot plates 75 and 76, slot size regulates the amount of hydraulic oil flow that pressurizes the ends of the spools 69 and 70. Accumulator 67 stores hydraulic oil that make up the difference in volume of the rod side to blind side of the vertical damper cylinder 56. The accumulator also pressurizes the vertical damper 10. There are various backing plate, fasteners and seals on control manifold 93 to contain the hydraulic fluid.

Figure 8B:
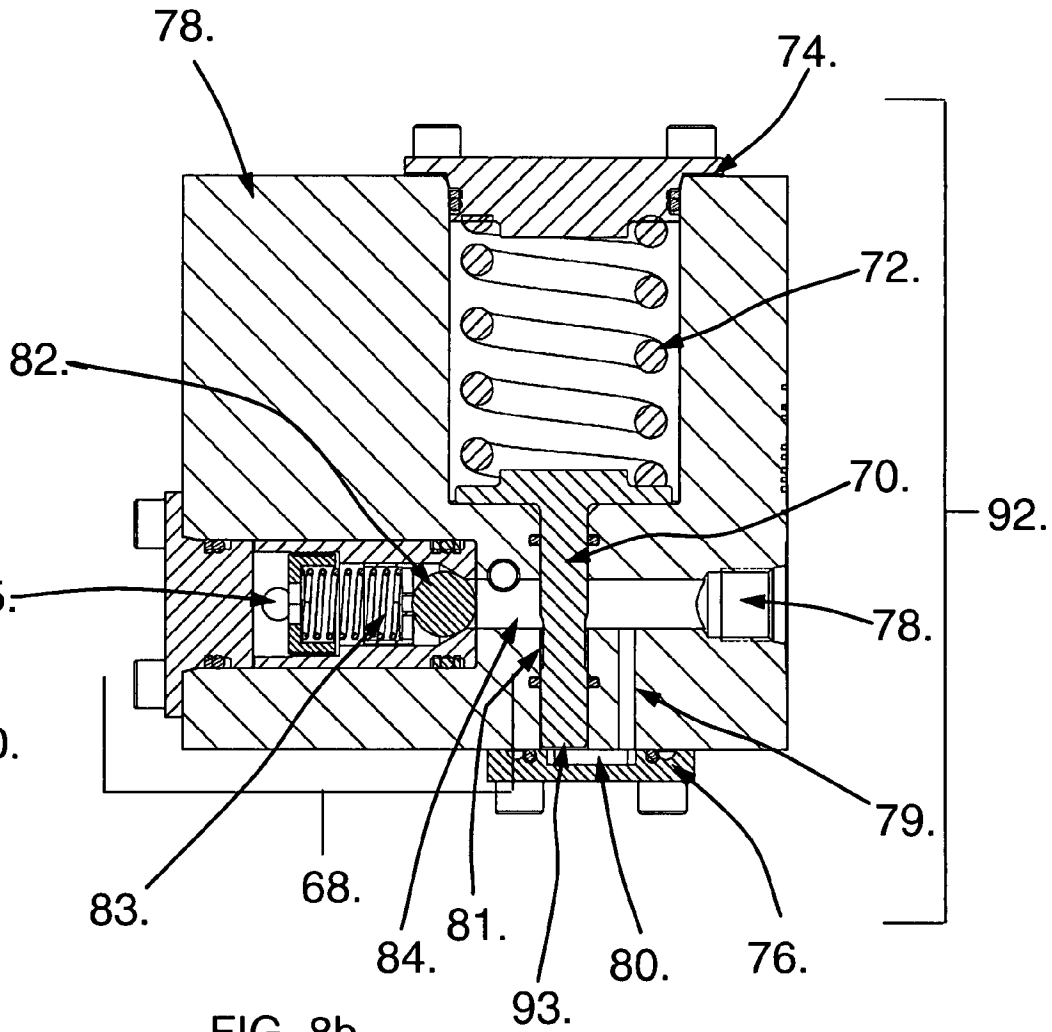
FIG. 8*b* is a detailed cross section of the control valve of a first embodiment of a railway car truck in accordance with the present invention.
Figure 8A:
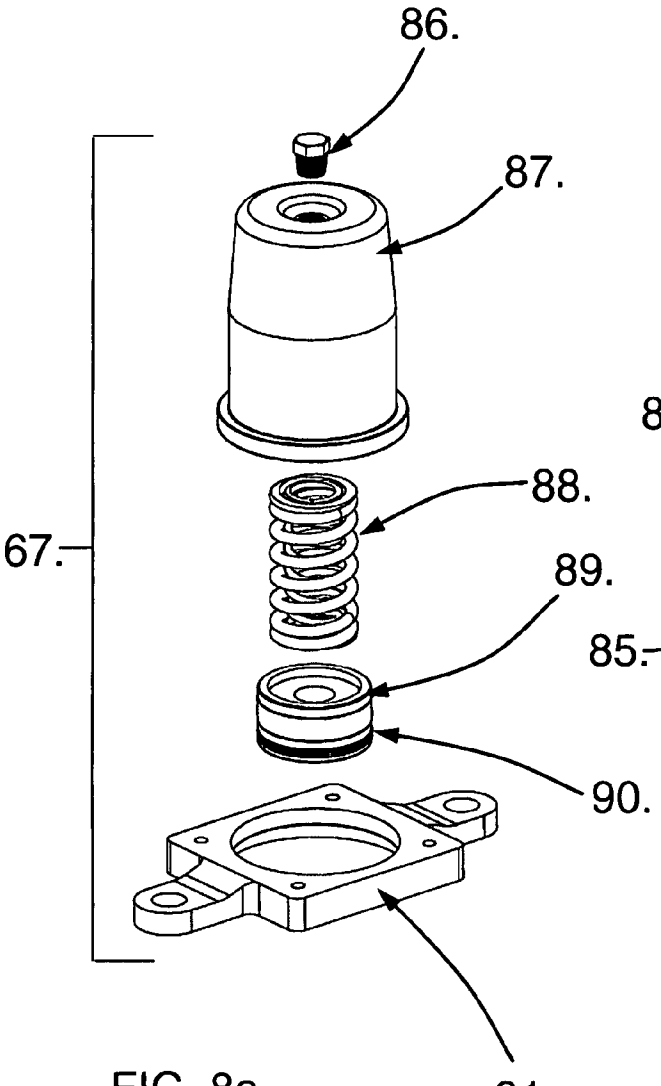
FIG. 8*a* is a exploded view of the accumulator the first embodiment of a railway car truck in accordance with the present invention.

Referring now to FIG. 8*a*, an exploded view of accumulator 67 is shown. Accumulator 67 is charged with hydraulic fluid to pressurize vertical damper 10 (not shown). Accumulator 67, provides area to store vertical damper 56 (not shown) excess hydraulic fluid of the blind side, when the hydraulic fluid flows to the rod side of vertical damper 10. Accumulator 67 is mounted to manifold 93 (not shown) by clamp 91. The accumulator reservoir 87 is comprised of a polycarbonate clear material to provide a means to visually verify that vertical damper 10 (not shown) is pressurized and contains hydraulic fluid. The hydraulic fluid is pressurized under piston 89 and is contained between accumulator reservoir 87 and piston 89 by seal 90. Accumulator 67 is initially charged with reserve hydraulic fluid. The reserve hydraulic fluid forces piston 89 into accumulator reservoir 87. Piston 89 compress springs 88. The initial charge hydraulic fluid becomes pressurized by the compressed springs 88, reacting on piston 89.

The volume on the non-charged side of accumulator 67 is vented to atmosphere through air breather 86.

Referring now to FIG. 8*b*, a cross section of the control valve 57 is shown. The cross section is one of two pressure compensated flow controls 92. There are two pressure compensated flow controls 92 in control valve 57. Each pressure compensated flow control 92 manages the hydraulic fluid flow and pressure of the rod side and blind side of the vertical damping cylinder 56. Pressurized hydraulic fluid from the rod side or blind side of vertical damping cylinder 56 (not shown) is routed through hose 58, to control valve 57, and to one of the pressure compensated flow controls 92. When external force is applied to the vertical damping cylinder 56, hydraulic fluid pressure and flow is created from the blind or rod side of cylinder 56 (not shown). The pressurized hydraulic fluid simultaneously enters chambers 78, 79, and the slot in pilot plate 76, of the pressure compensated flow control 92. The hydraulic fluid pressure over the diameter area 93 of spool 70 creates a force that reacts against spring 72. Spring 72, stiffness is such that as the hydraulic fluid pressure increases, reacting on the diameter area 93 of spool 70, causes the spring 72 to deflect at a given rate. As spring 72 deflects, spool 70 follows due to hydraulic fluid pressure on the diameter area 93. The land 81 of spool 70 is a reduced diameter compared to the spool diameter. As the pressure on diameter area 93 increases and spool 70 deflects, land 81 moves across the chamber 78. As land 81 moves across chamber 78, the reduced diameter increases the area allowing hydraulic fluid flow from the front of chamber 78 to the back of chamber 84. The hydraulic fluid pressure and flow now encounters check valve 68. Check valve 68 allows hydraulic fluid flow from one direction. Check valve 68 contains a ball 82 that is held in place by spring 83. The hydraulic fluid pressure and flow at the back of chamber 84 presses on the end of ball 82. Ball 82 presses on spring 83. Spring 83 stiffness is such that from the pressure on the end of ball 82, and spring 83, opening area for hydraulic fluid flow around ball 82 is affected. The hydraulic fluid continues to flow through check valve 68 to opening 85, where the hydraulic oil returns to the rod or blind side of the vertical damping cylinder 56 (not shown).

What is claimed is:

1. A railway car truck comprising two sideframes, each sideframe having a pedestal formed on longitudinally opposite ends thereof and substantially upright columns defining a sideframe opening intermediate the pedestals and an upper section between the columns, each pedestal having a pedestal opening, a bolster transverse relative to the sideframes and having laterally opposite ends, each end extending into and supported within a sideframe opening, the bolster including an upper surface and lower surface, the bolster also including two laterally spaced side bearing pads on the upper surface of the bolster between the sideframes, a side bearing on each side bearing pad, a transom transverse relative to the sideframes and having laterally spaced opposite ends, each transom end entering into and supported within a sideframe opening, and the transom including a lower surface, a spring group in each sideframe opening that supports a respective end of the bolster, the spring group being supported at a respective end of the transom, a vertical damping cylinder connected between the bolster and the upper section of a sideframe, a lateral damping cylinder connected to the lower surface of the bolster and to the lower surface of the transom and, a bearing adapter and an elastomeric adapter pad received in each pedestal opening of each sideframe.

2. The railway car truck of claim 1 wherein the bolster includes a bolster pocket extending from the lower surface of the bolster and one vertical damping cylinder is connected between each bolster pocket and the upper section of a sideframe.

3. The railway car truck of claim 1 wherein two lateral damping cylinders are connected between the lower surface of the bolster and the lower surface of the transom.

4. The railway car truck of claim 2 wherein each bolster end includes two vertical openings, and one of the vertical damping cylinders is located in each bolster end vertical opening.

5. The railway car truck of claim 2 wherein each vertical damping cylinder provides damping for both upward movement of the bolster relative to the sideframe and downward movement of the bolster relative to the sideframe.

6. The railway car truck of claim 3 wherein each lateral damping cylinder provides a damping force of 199 pounds per inch per second (3,559 kg per meter per second) of travel.

7. The railway car truck of claim 2 wherein the two vertical damping cylinders provide a damping force of 600 pounds per inch per second (10, 715 kg per meter per second) of travel.

8. A railway car truck comprising two sideframes, each sideframe having a pedestal formed on longitudinally opposite ends thereof and substantially upright columns defining a sideframe opening intermediate the pedestals, and an upper section between the columns, each pedestal having a pedestal opening, a bolster transverse relative to the sideframes and having laterally opposite ends, each end extending into and supported within a sideframe opening, the bolster including an upper surface and a lower surface, the bolster also including two laterally spaced side bearing pads on the upper surface of the bolster between the sideframes, a side bearing on each side bearing pad, a transom transverse relative to the sideframes and having laterally spaced opposite ends, each transom end extending into and supported within a sideframe opening, and the transom including a lower surface, a spring group in each sideframe opening that supports a respective end of the bolster, the spring group being supported on a respective end of the transom, two vertical damping cylinders connected between the bolster and the upper section of each sideframe, a lateral damping cylinder connected between the lower surface of the bolster and the transom, a bearing adapter and an elastomeric adapter pad received in each pedestal opening of each sideframe.

9. The railway car truck of claim 8 wherein each bolster end includes two vertical openings, and one of the vertical damping cylinders is located in each vertical opening.

10. The railway car truck of claim 9 wherein each vertical damping cylinder provides damping for both upward movement of the bolster relative to the sideframe and downward movement of the bolster relative to the sideframe.

11. The railway car truck of claim 8 wherein each lateral damping cylinder provides a damping force of 199 pounds per inch per second (3,559 kg per meter per second) of travel.

12. The railway car truck of claim 8 wherein the two vertical damping cylinders provide a damping force of 600 pounds per inch per second (10,715 kg per meter per second) of travel.

* * * * *